United States Patent [19]

Hangarter et al.

[11] Patent Number: 4,622,910

[45] Date of Patent: Nov. 18, 1986

[54] BUTTON HOLE SEWING DEVICE

[76] Inventors: Otto Hangarter, Mathias Claudius Str. 22, 7707 Engen, Fed. Rep. of Germany; Hansulrich Lerch, Zelgistrasse 11; Otmar Stillhard, Ofenbachstrasse 14, both of 8266 Steckborn, Switzerland

[21] Appl. No.: 745,892

[22] Filed: Jun. 18, 1985

[30] Foreign Application Priority Data

Jun. 27, 1984 [CH] Switzerland ..... 3105/84

[51] Int. Cl.[4] ..... D05B 3/06

[52] U.S. Cl. ..... 112/447

[58] Field of Search ..... 112/447, 446, 315, 121.11, 112/121.12, 264.1, 235, 65

[56] References Cited

U.S. PATENT DOCUMENTS 3,596,618 8/1971 Goldbach et al. ..... 112/446
3,654,882 4/1972 Kamena ..... 112/121.11
4,019,449 4/1977 Hauf ..... 112/446
4,393,797 7/1983 Marsh ..... 112/447
4,458,612 7/1984 Asai et al. ..... 112/447

*Primary Examiner*—Peter Nerbun

[57] ABSTRACT

The button hole presser foot engages longitudinally slidably in a frame like slide which is taken along with the sewing material. The slide comprises a cord stretched in the longitudinal direction which encircles the lower end of a shaft of the presser foot shank. At the top end of the shaft is provided an impeller through which a light beam of a light source emerges toward a optoelectric transducer. During the sewing operation the slide moves with the sewing material and it drives the impeller which generates pulses each corresponding to a step of the motion of the sewing material, respectively of the slide. For determining the length of the cords, a determined number of steps, respectively of pulses is counted each time. This permits a reliable and precise determination of the length of the cords.

20 Claims, 12 Drawing Figures

4
10
9
25
26
64
63
7
6
10b
13
8
7a
52
53
6a
4c
103
54
62
61
16
15
4b
102
10a
101
60

BUTTON HOLE SEWING DEVICE

BACKGROUND OF THE INVENTION

The present invention relates to a button hole sewing device with a mechanism to be set on the sewing material and taken along by the latter and with control means for controlling the sewing process on the base of the movement of the mechanism. In this meaning, presser feet are more particularly known having slide like ground plates which are taken along together with the sewing material during the button hole sewing process and which are provided with marks in order to indicate the beginning and the end of the button hole sewing process. In this connection it is also known to sense by optical means the initial and the end position, respectively the intermediate or reversing position of the mobile ground plate which determines the length of the button hole, these optical means delivering corresponding signals to an electronic circuit which releases the corresponding control process (U.S. Pat. No. 4,216,732 U.S. Pat. No. 4,242,976).

In the place of slides which are taken along by the sensing material it is also known to use measuring wheels to be put on the sewing material and which comprise position encoders with optical sensor means e.g. reflectors in order to mark the initial and the end position (U.S. Pat. No. 3,596,618, U.S. Pat. No. 4,019,449). It is difficult in this case to associate with precision the beginning and the end of the sewing operation to the beginning and the end of the positions optically sensed.

SUMMARY OF THE INVENTION

It is the object of the present invention to realize a button hole sewing device permitting to control the sewing operation in a precise and reliable manner. To this end, the button hole sewing device is characterized in that there is provided a distance sensing device which senses partial steps of the mechanism and in that the control means are designed for counting predetermined numbers of partial steps and to reverse the sewing operation when the predetermined numbers are attained. Due to the fact that the distance is sensed by partial steps and not by determined initial and end positions it is not necessary to take care for the coincidence between the optically sensed initial and end positions and the effective initial and end positions of the sewing operation.

All of these mentioned known devices, either slides or measuring wheels for optically sensing the initial and the end position of the sensing mechanism of the button hole sewing process present further drawbacks. One of these arising from the rapid dirt accumulation on the reflectors which signalize the different positions and which are arranged at close proximity of the sewing material or which move at close proximity of the latter. During the sewing process, relatively much dust is produced which deposits on the reflectors and hinders the reflection of light. The sensors are at a relative great distance of the reflectors so that a precise determination of the end positions becomes difficult even in the absence of disturbances due to dirt accumulation. In this connection, faulty switching may also easily occur due to scattered light, parasitic light, sweep of the parts supporting the reflectors when sewing over unevennesses in the sewing material and further influences. It is therefore preferable to provide a particular distance sensing device for sensing partial steps of the mechanism, respectively of the sewing material which is located and protected at a distance of the proper sewing place. The counting becomes more secure and a higher resolution is achieved, more particularly when the movement of the mechanism, respectively of the sewing material is transmitted with amplification to the distance sensing device. Due to the fact that the distance sensing device can be located in a position independent from the mechanism which lies on the sewing material and which may move not only in the direction of sewing but also at right angle with respect to the latter, the influences due to the unevennesses of the sewing material are eliminated.

The sensing of steps of the movement of the sewing material, respectively of the mechanism lying thereon is particularly well suited for digital processing in accordance with the invention and for storing data of the pattern of a sewing operation and for automatically controlling further sewing operations by means of the retrieved stored data. It is thus possible to execute a first sewing operation not at the proper sewing material but at a sample specimen and to store at least the number of partial steps for each cord of the button hole sewing operation. When the sewed and cut open button hole is determined to be correct for the foreseen button, the data may be definitively stored and thus retrieved afterward for automatically controlling the proper sewing operation at the sewing material. This permits to avoid faulty button holes at the proper sewing material. Correspondingly, appropriate numbers of steps could also be introduced and stored by means of a sensor sensing the diameter and the thickness of a button so that sewing operations could be controlled by means of these stored numbers of steps. It is also further possible to sew in the first place a pattern by means of the stored numbers of steps and to carry out a correction by somewhat increasing or decreasing the stored numbers using this pattern.

It is further also known, in order to sew two material layers together in aligned position, to provide measuring wheels which fit closely on the top end and on the bottom end of the sewing material, these measuring wheels cooperating with transducers delivering pulses as a function of the rotation of the wheels, these pulses being processed in order to vary the relative speed of the top and bottom feeds in accordance with the actual feed of the material layers (U.S. Pat. No. 3,954,071). However, no solution for button hole sewing is disclosed nor suggested.

The invention will be described further by way of example and with reference to the accompanying drawings.

DESCRIPTION OF THE PREFERRED EMBODIMENT

Figure 1:
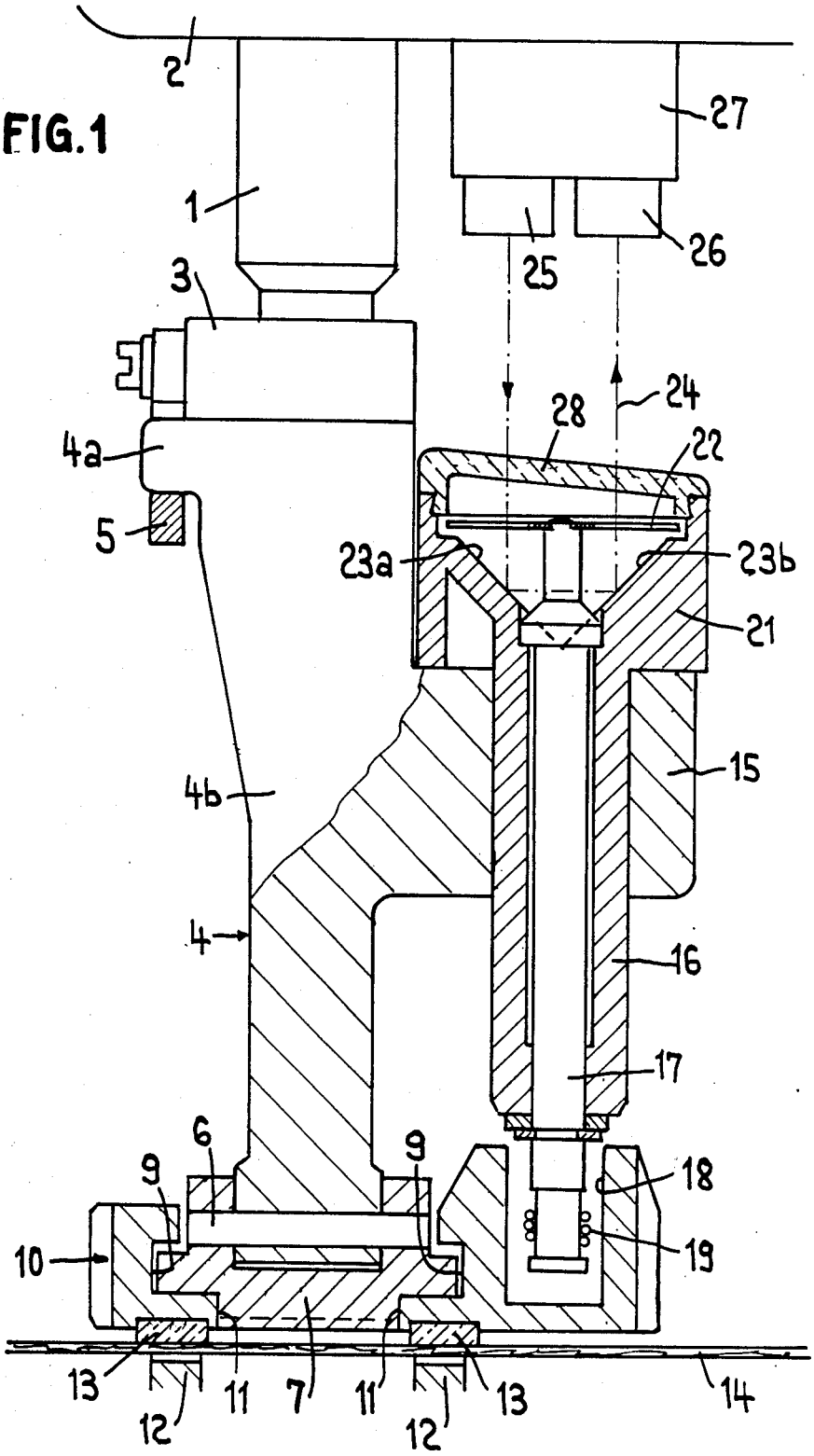
FIGS. 1 and 2 show a sectional elevation, respectively a top view of the first example of execution separated from the sewing machine.

FIG. 1 shows the presser bar 1 of a sewing machine, this presser bar being secured in the frame of the machine in the housing part 2 of the latter. The presser foot 4 provided for button hole sewing is removably secured to the coupling part 3 of the presser bar 1 by means of an eccentric lever 5 which engages below a lifter 4*a* of the presser foot shank 4d*b*. The lower end of the presser foot shank 4*b* is slewably connected to a presser foot plate 7 by means of a pin 6. This plate 7 comprises an oblong hole 8 which is provided for the passage of the sewing needle. The parts so far described correspond essentially to the usual parts utilized for button hole sewing in a sewing machine.

Figure 2:
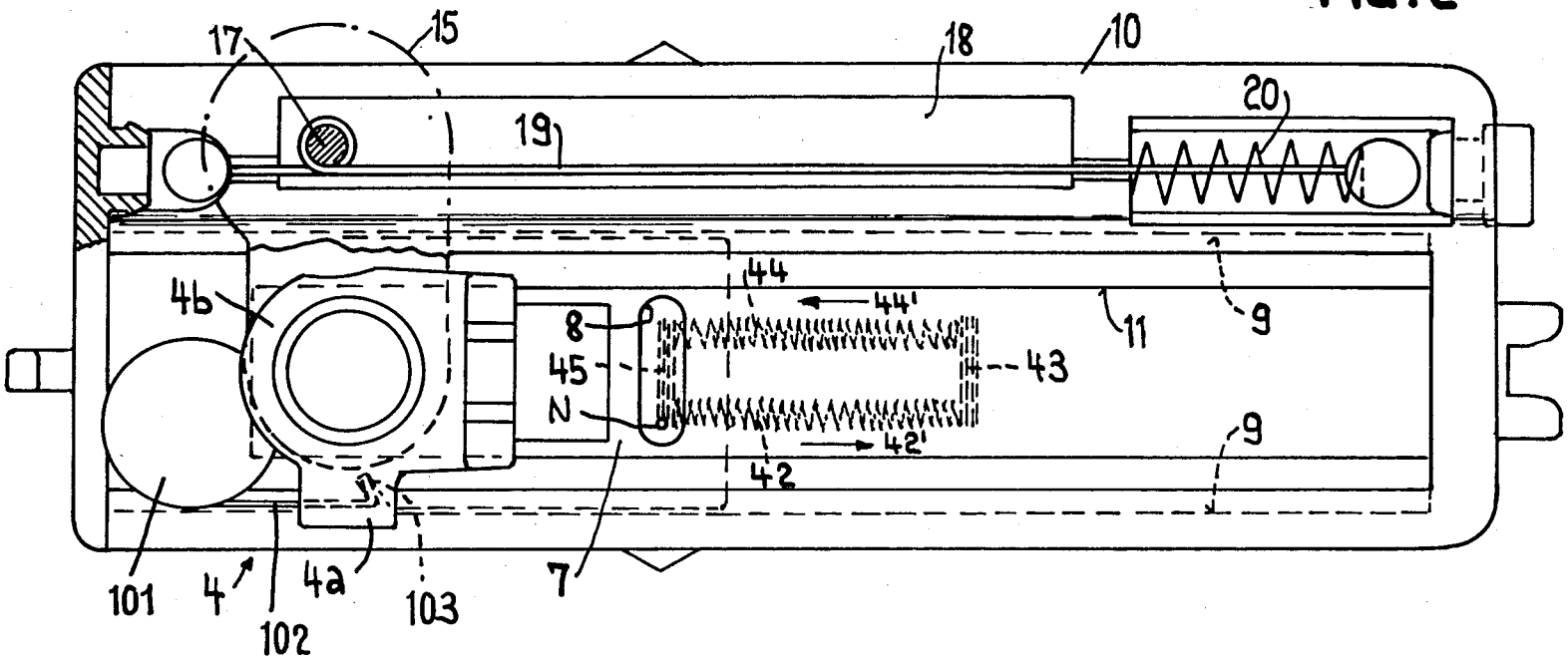

The plate 7 engages longitudinally slideably with lateral guides into grooves 9 of a frame like slide 10 comprising at the bottom an oblong rectangular aperture 11 the width of which being sufficient for permitting the passage of the needle in all of its positions required for sewing the bartacks and the cords of the button hole. The length of the aperture 11 is sufficient for permitting a sufficient displacement of the slide 10 with respect to the needle and the presser foot plate 7 in order to allow the machine to sew the greatest possible button holes. In the range of each toothed stem 12 of the transporter is provided at the lower side of the slide 10 a slightly projecting rubber coating 13 lying on the sewing material 14 for ensuring a good adherence between the slide and the sewing material. To the slide 10 is secured a spring housing 101 in which one end of a spring 102 is anchored while the hook like end is engaged in a notch 103 of the plate 7. The continuously acting force of the spring 103 directed toward the spring housing 101 urges the slide 10 to stop in an initial position against an abutment not shown (FIG. 2).

Figure 3:
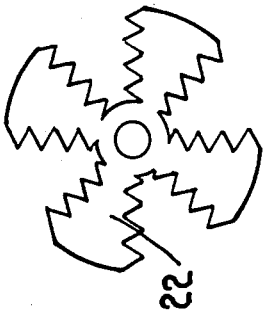
FIG. 3 shows a top view of a rotating impeller of the distance sensing device.

A bearing bushing 16 in which a vertical shaft 17 is rotatively supported is held in a lateral eye 15 of the presser foot 4. This shaft engages by its lower end into an oblong groove 18 of the slide 10. This lower end of the shaft 17 is encircled by a few windings of a cord 19 which extends longitudinally through the groove 18 and is anchored to the extremities of the slide 10, one of the anchoring places being submited to the pressure of a spring 20 which causes an appropriate tension in the cord 19. When the slide 10 moves with respect to the plate 7, the chord 19 is displaced with the slide 10 and this chord causes the shaft 17 to rotate. The upper end of the shaft 17 lies in a housing like enlargement 21 of the bearing bushing 16 and it supports an impeller 22 which is illustrated in FIG. 3. The impeller is a wheel comprising four wings the radial edges of which being toothed for reasons which will be explained later. Below the impeller 22 are provided two plane reflecting surfaces 23*a* and 23*b* which serve as double reflector for a light beam 24 delivered by an appropriate light source 25 and entering at the side of the shaft 17 into a photoelectric transducer 26 as far as it is not stopped by the wings of the impeller 22. The light source 25 and the transducer 26 are mounted in a housing 27 which in turn is connected to the housing part 2 of the sewing machine or with the machine frame at proximity of this housing part. The housing in which the impeller 22 is lodged comprises at the top a light transparent cover 28 which is somewhat inclined with respect to a normal plane of the incoming and outcoming light rays in order to avoid possible reflections.

Figure 4:
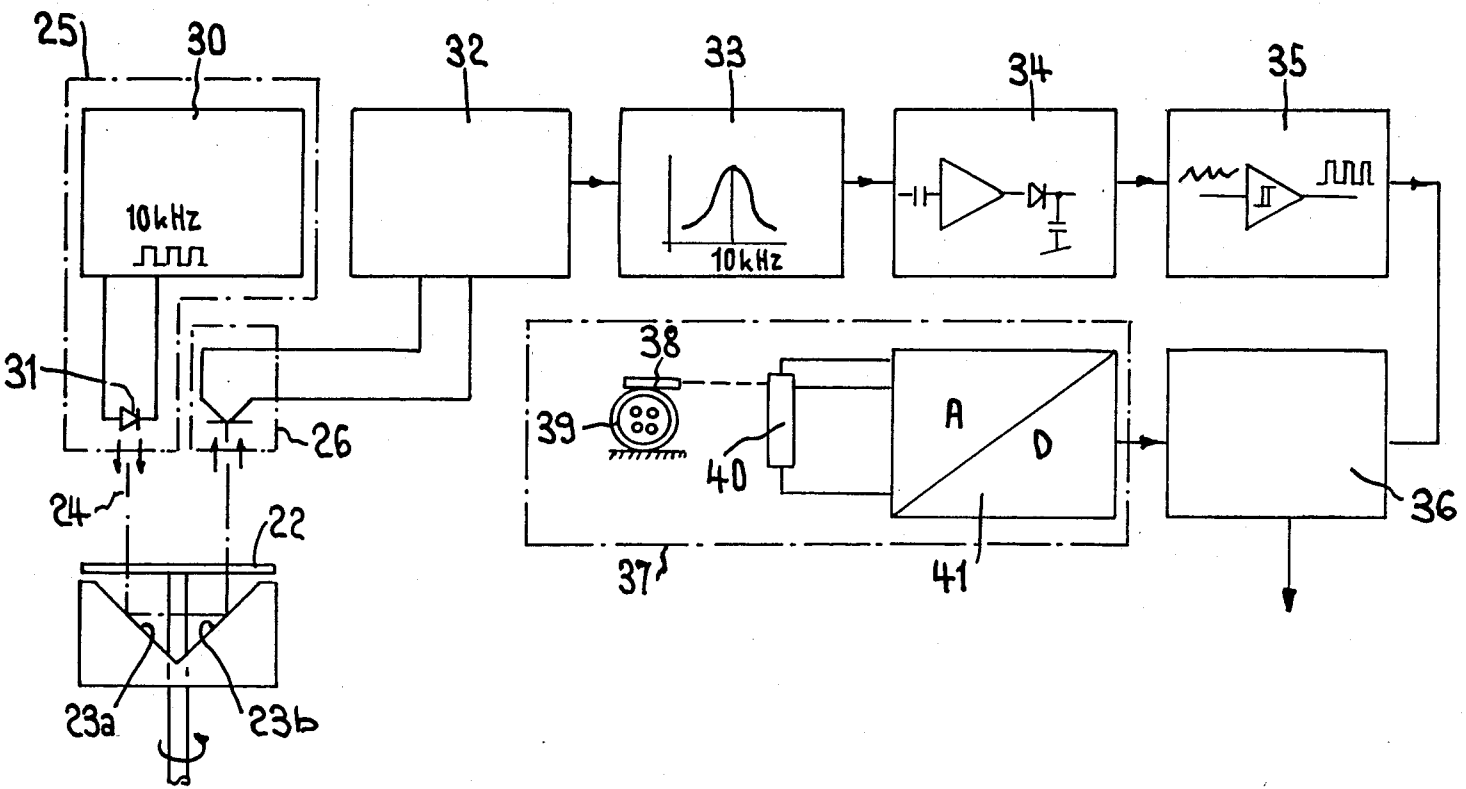
FIG. 4 shows a block diagram of the optical and electronic parts of the device.

FIG. 4 shows an oscillator or chopper 30 delivering an alternating, respectively chopped current to a light emitting diode 31 with a frequency of e.g. 10 kHz. The light beam 24 delivered by the light source 25 is therefore amplitude modulated by this frequency. As described above, the light beam passes through the impeller 22 and by means of the reflector 23 to the photoelectric transducer 26 which can be e.g. a phototransistor. The signal of this photoelectric transducer 26 is delivered to a working point regulator 32 and from the latter to a filter 33 the transmission band of which being centered at 10 kHz. The signal delivered by the filter 33 is amplified and rectified in a following stage 34. The rectified pulses are shaped in a threshold switch 35 and they arrive from the output of the latter to an electronic counter and comparator 36. In the simplest case, this electronic counter and comparator can effectively compare only a determined number of pulses with a predetermined number of pulses and deliver by coincidence of these numbers a control signal which causes a change of the sewing operation. More generally, one will provide a microcomputer capable in accordance with predetermined programs of storing data corresponding at least to a sewing operation and then of controlling full automatically a sewing operation in accordance with the stored data. This function will be further explained later.

FIG. 4 shows also an input device 37 permitting by means of a mobile tracer 38 to determine the diameter and possibly the thickness of a button 39. As shown in FIG. 4, the tracer 38 is mechanically coupled to the potentiometer 40 which delivers to an analog-digital-converter 41 signals corresponding to the diameter, respectively to the thickness of the button. The analog-digital converter delivers to the counter, respectively the microcomputer 36 numbers proportional to the diameter, respectively the thickness of the button 39. The microcomputer transforms these numbers in accordance with a predetermined program in numbers of steps which are utilized to automatically control the sewing operation of a button hole adapted to the sensed button.

FIG. 2 shows schematically how the sewing operation of a button hole takes place. Starting with the position of the slide 10, of the presser foot 4, 7 and of the needle N as indicated in FIG. 2, one sews in the first place a cord 42 in the direction of the arrow 42'. Due to the fact that the presser foot plate 7 and the needle N do not move during the sewing operation, the sewing material 14 is shifted in the opposite direction toward the left in FIG. 2 with respect to these parts. The sewing material carries along the slide 10 in this direction and the needle executes a reciprocating stitching movement in order to form the cord 42. During the movement of the slide 10 the shaft 17 and thus the impeller 22 are driven by the chord 19 so that the light beam 24 is alternatively stopped and transmitted by the wings of the impeller. The movement of the slide is transmitted with amplification to the effective places of the impeller 22 because the diameter of this impeller at the emerging places of the light beam 24 is substantially greater than the diameter of the part of the shaft 17 which is encircled by the chord 19. This permits a higher resolution, respectively a more precise measurement of the distance of displacement of the slide 10. Light pulses corresponding to the rotation of the impeller 22 arrive to the photoelectric transducer 26 which delivers electrical pulses to the regulator 32, the filter 33 and the amplifier-rectifier 34 and finally from the threshold switch 35 to the counter and comparator, respectively the microprocessor 36. The numbers of these pulses is representative of the displacement of the slide 10. Due to the fact that the light is amplitude modulated with a relatively high frequency and that other parasitic light beams are filtered out, the pulses become relatively free of unwanted light influences. As already indicated, the resolution is relatively high. The impeller 22 which is located fully protected in a housing and the cover 28 which is traversed two times by the light beam are positioned far above the sewing location so that they are practically not submitted to dirt. A cleaning by means of a cloth to be executed from time to time is extremely easy to perform. The indentation of the radial edges of the impeller 22 has the purpose of slowing down the interruption and the transmission of the light beam. This permits to avoid, in the case of an irregular rotation of the impeller or even in the case of a small back motion of the latter during the intermission of the advance of the sewing material, that additional pulses not corresponding to the advance motion of the sewing material be generated and counted. When the desired length of the first cord 42 is attained, the numbers of pulses, respectively of the steps of the slide 10, respectively of the sewing material is stored in the circuit 36. Then a few stitches are executed for sewing a bartack 43 at one end. Then the other cord 44 is sewed in the direction 44' whereby the number of steps is sensed and when this number becomes equal to the number of steps which was previously required for the cord 42, the sensing process is stopped. Then a few stitches are executed for sewing a bartack 45 at the other end so that the sewing of the button hole is completed. Further button holes for buttons of the same dimensions and for the same sewing material may then readily be sewed in the correct dimensions by counting in each case the number of steps per cord. In this connection, the order in which the different sewing operations for a complete button hole are performed is unimportant, that is the sewing operations may also begin with the cord 44. The sewing procedure may be further automatized if a microcomputer is used in place of the simple counter and comparator circuit 36. Both cords 42 and 44 and both bartacks 43 and 45 may be full automatically sewed in accordance with predetermined numbers of steps and further program parts. This full automatic sewing may be performed using data which is entered by means of the circuit 37.

Various additional measures and variants are possible. As an example, a distance sensing device having e.g. a double receiver could be provided for also sensing the direction of motion and for subtracting the steps during the reverse motion with respect to the sewing direction. This measure would permit to avoid the risk that the advance of the sewing material and thus the length of the cord is not correctly sensed due to the fact that the sewing material advances stepwise and that it may slide slightly backwards between the individual transporting phases. It would also be possible for a determined angular range to be sensed of the arm shaft of the sewing machine to electronically interrupt the counting of the pulses between the transporting phases, respectively during the sewing operation.

Another distance sensing device could also be provided which would operate e.g. on an electromagnetic principle. The illustrated distance sensing device which operates on the principle of a light barrier has however the advantage that no mechanical nor electrical connection is required between the two parts of the distance sensing device namely the optical emitter 25 and receiver 26 and the impeller 22. It is sufficient to correctly insert the presser foot and to set the device to work. A sector comprising disc could also replace the impeller whereby alternatively one sector would be reflective and the following sector would be flat-black. Above this disc is stationary located a second disc having the same partition of the sectors, these sectors being alternatively light transparent and flat-black non transparent. The lower disc would be driven by the slide 10 as previously illustrated and described. A general illumination coming from above would be strongly reflected when the reflective sectors would be below the light transparent sectors of the upper disc while practically all the light would be absorbed when the flat-black sectors of the lower disc would be below the light transparent sectors of the upper disc. In this way light pulses and finally electric pulses could be generated each one of these corresponding to one step of the slide motion.

Figure 5:
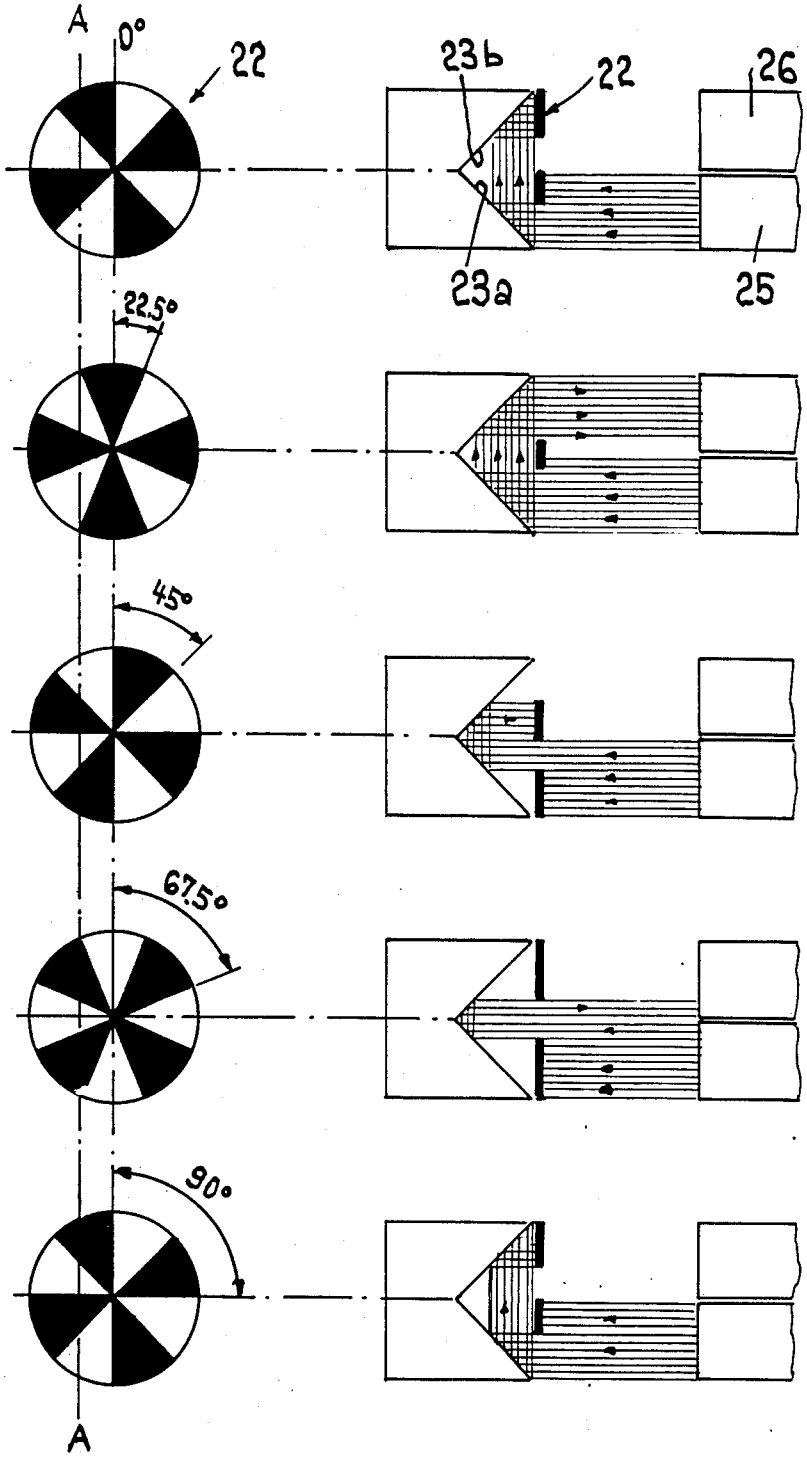
FIG. 5 shows a variant of the distance sensing device of the first example of execution.
Figure 6:
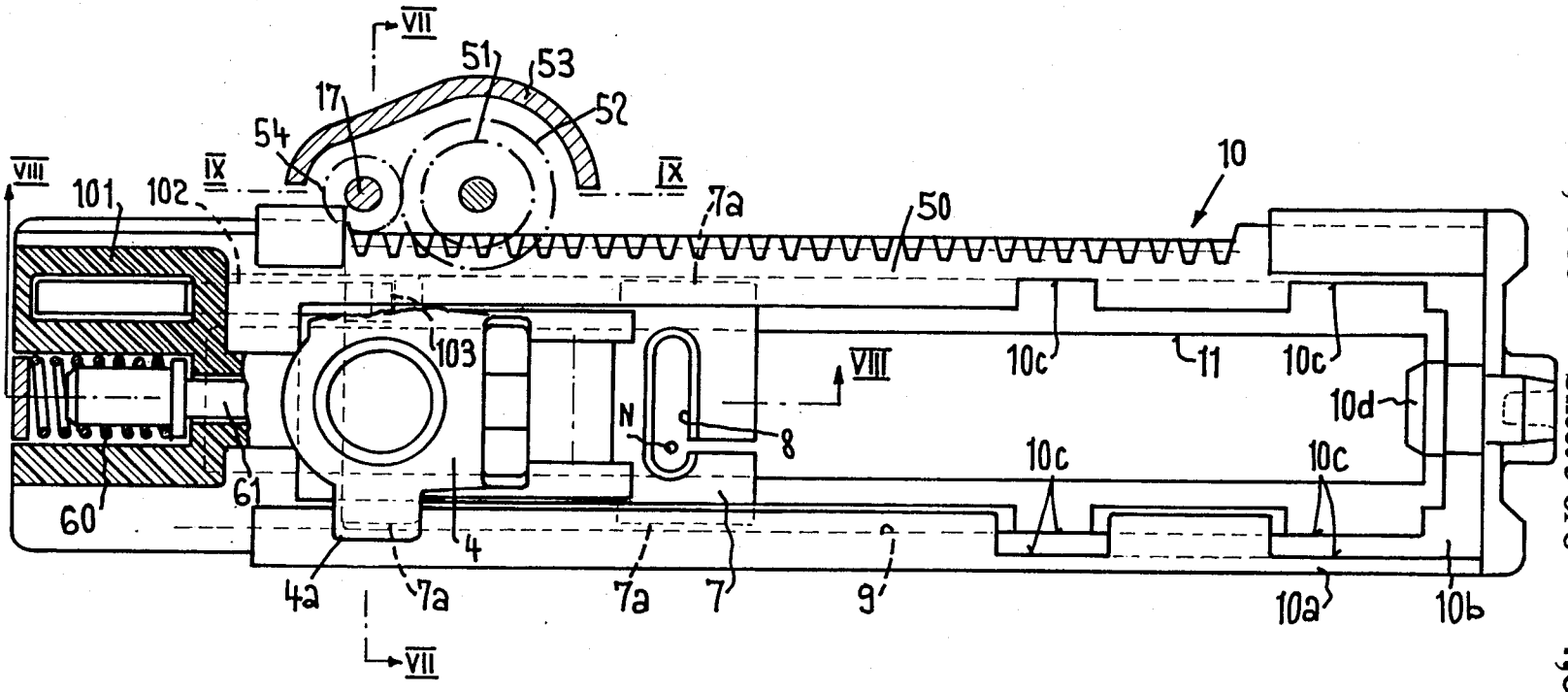
FIG. 6 shows a top view of the second example of execution with a partial sectional view.

It was previously assumed that a relatively sharp focussed light beam was passing eccentrically on the side of the shaft 17. But it is also advantageous to operate with a light source which illuminates a great surface of the impeller. It is possible to show that a doubling of the light pulses is achieved in the illustrated device where the path of the light beam passes over the two plane inclined mirror surfaces **23*a* and 23*b* of the reflector. This is illustrated in FIG. 5 for the plane A—A. It is to be seen from the different representations that for each quarter revolution of the impeller two separate light pulses arrive at the receiver 26** so that with a four wings impeller eight pulses are generated for each revolution which corresponds to a doubling of the resolution.

This pulse doubling occurs independently from the number of wings of the impeller and it is caused by alternative variations of the light entering within the reflector and emerging from the latter during the rotation of the impeller. In this connection, the wings hinder alternatively the light to enter in the double reflector, respectively hinder the exit of the light which has penetrated into the reflector. From the example of FIG. 5 it is to be seen that the light beam is interrupted when with respect to a horizontal plane the reflected images of the wings cover the interspaces. Although the light entering through the interspaces is reflected in the reflector, it cannot emerge from the opposite side. Again with respect to a horizontal plane, a reflected overlap of the wings and the interspaces occurs when the impeller rotates of an angle equal to one half of the angle enclosed between the two edges of a wing. The light penetrating through the interspaces is reflected in the relector and it can freely emerge on the opposite side for being catched by the receiver. It is thereby not required that during the dark phases absolutely no light emerges from the device, respectively that the emitter 25 delivers no signal at all. It is sufficient that the intensity of the emerging light, respectively of the signal of the emitter changes with the corresponding frequency in which case electronic means provide for the desired resolution and the correct pulse counting and determination of the distance. It is also not required to provide the impeller with an even number of wings as illustrated in the example of execution.

FIGS. 6 to 11 show the second example of execution whereby corespponding parts having corresponding functions bear the same reference numbers as in FIGS. 1 to 5. At the place of a chord, the slide 10 is provided with a rack 50 which engages with a pinion 51 rotatively supported together with a gear 52 in a lower housing like enlarged part 53. The gear meshes with a pinion 54 secured at the lower end of the shaft 17. The gear drives by its motion the shaft 17 through the gear mechanism 51, 52, 54 with a certain amplification of the movement. Beside of this essential constructive difference with respect to the first example of execution, the slide is somewhat differently designed in that an insert of synthetic material 10b at which the rack 50 is also formed is inserted in a bowl like part 10*a*. Reliefs 10*c* are provided in the parts 10*a* and 10*b* through which lateral guides parts 7*a* of the plate 7 are introduced from above and which can then be shifted along the position illustrated in FIG. 6. An abutment 10*d* inserted afterward limits in the assembled condition the movement of the slide 10 with respect to the plate 7 in such a way that a step out of the guides parts 7*a* through the reliefs 10*c* is avoided.

Figures 8, 12:
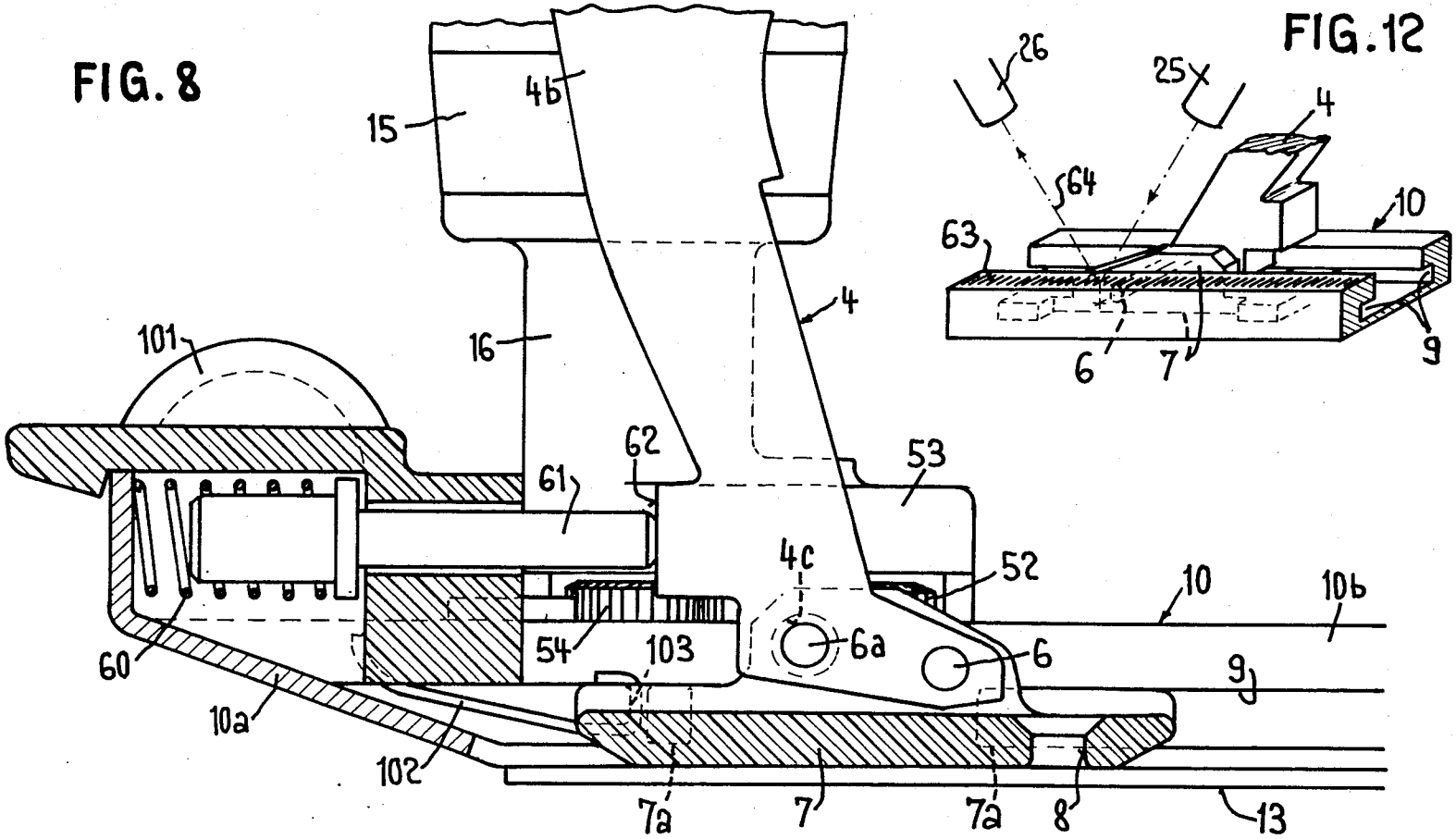
FIG. 12 shows schematically a variant of execution.
Figure 9:
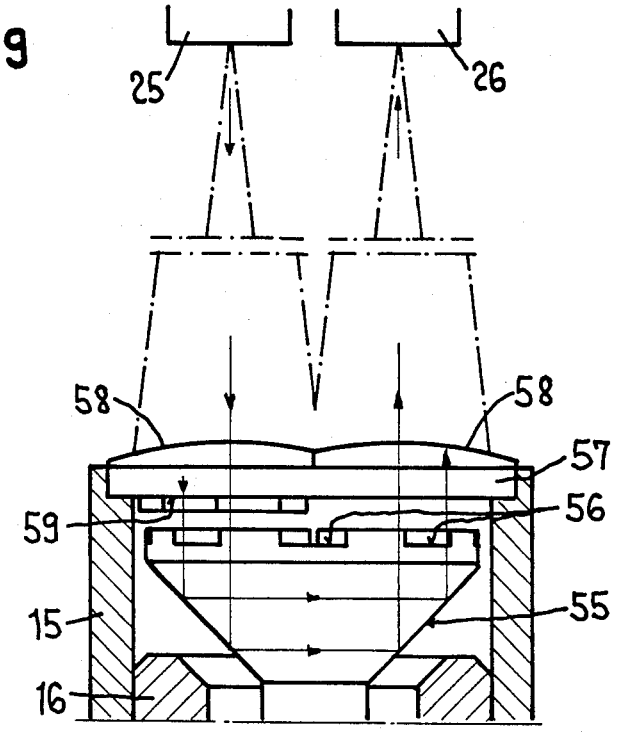
Figure 10:
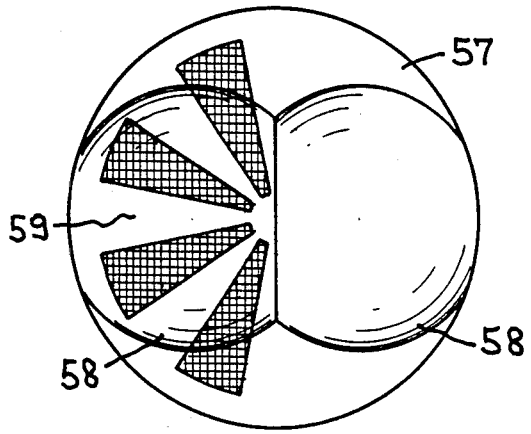
Figure 11:
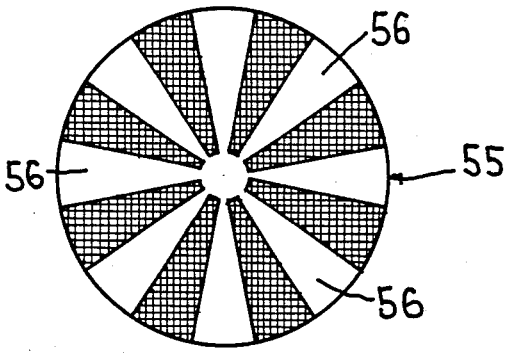

As shown in FIG. 8, beside of the pin 6 acting as a pivot, there is provided a further pin 6*a* going with play through a hole 4*c* of the presser foot 4 so that it forms a stop limiting the swivelling motion of the plate 7 around the pin 6. This limitation is particularly important in relation with the drive of the rack in order to maintain the play between the rack 50 and the pinion 51 to an acceptable dimension.

The shaft 17 bears at the top a transparent, conical optical reflector 55. The upper side of this reflector 55 is provided with radial, flat sector like grooves 56 and the upper sides of the flat segment like ribs comprised in between are provided with an opaque coating. A part 15 forming a tight housing is covered at the top with a transparent plate 57 which forms two adjacent lenses 58. Radial, flat segment like grooves 59 and ribs are formed at the flat lower side of the plate 57 in the range of one of the lenses (on the left in FIG. 9, respectively 10) and the outer surfaces of the ribs is also provided with an opaque coating. The light from the emitter 25 is aligned in parallel by the associated lens 58 (on the left in FIG. 9) and it goes only segmentwise through the plate 57. Depending on the angular position of the reflector, light goes through overlapping grooves or it is stopped by overlapping ribs. When the reflector rotates, light pulses are delivered to the light receiver 26 with the consequences described above. Eight segments of each sort are present in each case so that eight pulses emerge per revolution. Together with the amplification from the gear drive 51, 52, 54, an adequate resolution is achieved corresponding to about 0.5 mm of the displacement of the slide per pulse. The design of the reflector with grooves and ribs facilitates the stain of the ribs with the opaque coating. As indicated by the path of the rays in FIG. 9, the reflected light is focussed by the outlet lens 58 (on the right in FIG. 9) on the receiver 26 so that a much better luminous efficiency is achieved and more pronounced light signals, respectively light pulses are generated.

While in the example of execution according to FIGS. 1 to 5 the rest position of the slide under the action of the spring 102 is determined by a stationary stop not represented, in the example of execution according to FIGS. 6 to 11 there is provided a stop pin 61 loaded by a spring 60, a stop surface 62 of the presser foot 4 abuting against the stop pin 61 (FIG. 8). The force exerted by the spring 60 on the stop pin 61 is greater than the one of the spring 102 which according to FIG. 8 is lodged in a housing 101 which may be integral formed with the insert 10b. The stop position is thus well but not rigidly defined which permits as the case may be an overstepping of the slide over the stop position during the above described reverse motion of the slide sewing the second half of the button hole if the stored number of pulses while sewing the first half of the button hole is not fully attained because of slippage, tolerances and similar influences.

Characters of both examples of execution may be arbitrary exchanged. In this connection, a cover plate 57 with lenses 58 can be advantageously utilized with any light chopper other than the one illustrated in FIG. 8.

Figure 7:
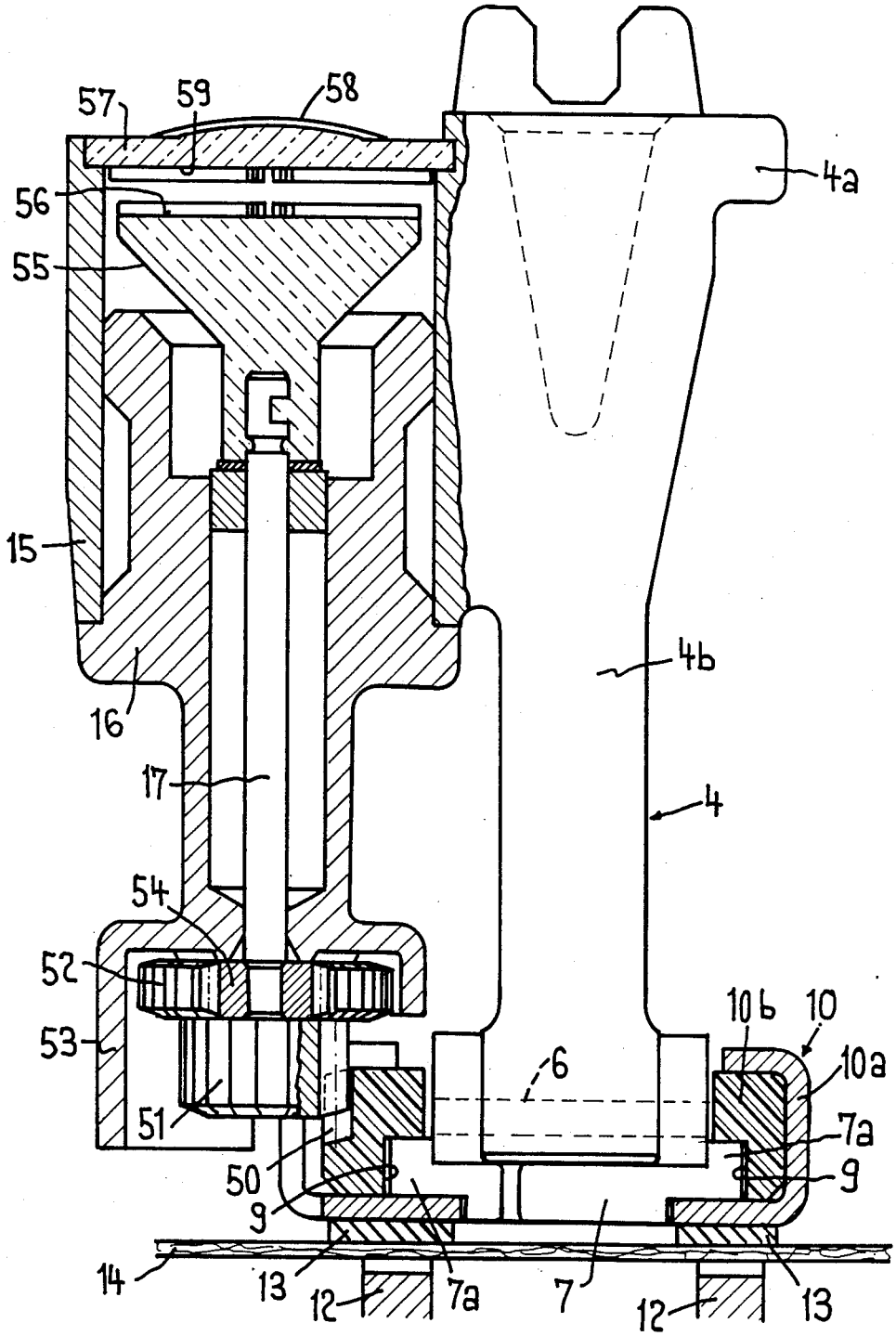
FIGS. 7 to 9 show each a partial sectional view according to the lines VII—VII, VIII—VIII, respectively IX—IX of FIG. 6, FIGS. 10 and 11 show each a top view of an element of the distance sensing device.

FIG. 12 shows a variant of execution in which the mechanical parts correspond to the ones of the execution according to FIGS. 7 and 8 and bear accordingly the same reference numbers. At the upper side of one of a longitudinal beam of the slide 10 there is provided a graduated scale 63 having a sufficiently fine graduation of e.g. 0.4 mm. This scale is scanned by a sharp focussed light beam 64 generated by an optical system in the light source 25 with a greater or smaller intensity when entering in the light receiver 26, depending on its incidence on a reflecting or absorbing place of the scale 63. As indicated in FIG. 12, the point of incidence must be located practically in the vertical plane including the pin 6 at which place the slide 10 is maintained down at a determined level by the presser foot 4 so that small swivelling movements of the slide due to unevennesses or differences in the thickness of the sewing material have no effect which causes no disturbances of the measurement of the way of the slide. Cleaner, e.g. brushes secured to the presser foot plate and lying on the graduated scale may be provided in front and behind the point of incidence in order to avoid the adverse dirt accumulation mentioned at the beginning. It would also be possible to provide an image forming optic in the light receiver 26 which projects the graduated scale on a sensor on which the bright and dark images of the movement of the slide travel.

We claim:

1. Button hole sewing device for a sewing machine, having a casing and a presser bar, comprising a presser foot removably connected to said presser bar, engagement means associated with said presser foot for engaging a material to be sewn and for movement within said presser foot with said material when it is sewn, a distance sensing device having a displaceable part near an upper end of said presser foot and near said presser bar, stationary optical detector means mounted on said casing of said sewing machine for optically detecting displacement of said displaceable part, transmission means for transmitting movement of said engagement means to said displaceable part, said distance sensing device being adapted for sensing partial steps of said material to be sewn, and control means associated with said distance sensing device for counting predetermined numbers of partial steps and for reversing the sewing operation when the predetermined numbers are attained.

2. Device according to claim 1, characterized in that the movement of said engagement means is transmitted with amplification to the distance sensing device.

3. Device according to claim 1 wherein said engagement means comprises a slide, said slide including a cord extending in the direction of movement, said cord encircling a shaft of a rotor of the distance sensing device.

4. Device according to claim 1, characterized in that the distance sensing device comprises an impeller having wings which permit to alternatively stop and release a light beam between a light source and a photoelectric transducer.

5. Device according to claim 4, characterized in that the impeller of the distance sensing device is rotatably mounted to the button hole presser foot shaft while the light source and the photoelectric transducer are mounted to the sewing machine, a reflector for the light beam being provided below the impeller.

6. Device according to claim 5, characterized in that the light incident in a double reflector emerges at an opposite side.

7. Device according to claim 6, characterized in that the impeller is arranged over two flat mirror surfaces of the reflector enclosing an angle between themselves which causes a doubling of the emerging light pulses.

8. Device according to claim 5, characterized in that the edges of the wings of the impeller are toothed.

9. Device according to claim 5, characterized in that the light source is amplitude modulated and in that the signal of the photoelectric transducer is delivered to a filter having a transmission band corresponding to the modulation frequency.

10. Device according to claim 1, characterized in that the distance sensing device senses the direction of motion and in that during the reverse motion it subtracts steps related to the respective sewing direction.

11. Device according to claim 1, characterized in that the distance sensing device is arranged at least partially protected in a housing at a distance of the sewing place.

12. Device according to claim 4, characterized in that a cover glass of a housing encircling the impeller is inclined with respect to a plane normal to the direction of the incident light.

13. Device according to claim 1, comprising means for storing data of a sewing operation on a sample specimen and to automatically control further sewing operations by means of the retrieved data.

14. Device according to claim 13, characterized in that numbers of steps corresponding to the diameter and the thickness of a button are seized by means of a tracer and are entered and stored in the device, sewing operations being then controlled by these stored number of steps.

15. Device according to claim 1, characterized in that the counting of partial steps is interrupted between the transporting phases, respectively the respective sewing operations.

16. Device according to claim 1, characterized in that said engagement means is provided with a rack coupled through a gear with the distance sensing device.

17. Device according to claim 1, characterized in that the distance sensing device comprises a rotating element alternatively releasing and stopping a light ray or a light beam of a light emitter and in that a lens is disposed between the element and the light emitter, as well as between the element and the light receiver.

18. Device according to claim 17, characterized in that the lenses are integral with a transparent cover of a housing.

19. Device according to claim 17 or 18, characterized in that the element is in form of a transparent conical reflector comprising alternatively transparent and opaque segments at the entrance and exit places of the light.

20. Device according to claim 1, characterized in that said engagement means is submitted to the action of a spring by which it is urged against a stop in a rest position and in that the stop is spring mounted.

* * * * *